US005255482A

United States Patent [19]

Whitacre

[11] Patent Number: 5,255,482

[45] Date of Patent: * Oct. 26, 1993

[54] TILE FLOORING STRUCTURE

[75] Inventor: Daniel C. Whitacre, Massillon, Ohio

[73] Assignee: Loretta A. Whitacre, Massillon, Ohio

[ * ] Notice: The portion of the term of this patent subsequent to Oct. 1, 2008 has been disclaimed.

[21] Appl. No.: 768,025

[22] Filed: Sep. 30, 1991

Related U.S. Application Data

[63] Continuation-in-part of Ser. No. 433,656, Nov. 8, 1989, Pat. No. 5,052,161.

[51] Int. Cl.[5] ..... E04F 15/02

[52] U.S. Cl. ..... 52/390; 52/385; 52/386; 52/389; 52/392

[58] Field of Search ..... 52/390, 384, 385, 386, 52/389, 392

[56] References Cited

U.S. PATENT DOCUMENTS 3,440,787 1/1967 Bathille ..... 52/309
5,052,161 11/1992 Whitacre ..... 52/385

OTHER PUBLICATIONS

ECB Membrane, "The 'One-Step' Problem Solver", product bulletin 2 pages; published by N.A.C. Products, Inc., Cuyahoga Falls, OH.; publication date not known (ECB-Membrane I).

ECB Membrane, "Elastomeric Crack Bridging Membrane", product bulletin, 2 pages, published by N.A.C. Products, Inc., Cuyahoga Falls, OH.; publication date not known (MCB Membrane II).

*Primary Examiner*—Carl D. Friedman
*Assistant Examiner*—Matthew E. Leno
*Attorney, Agent, or Firm*—Oldham, Oldham & Wilson Co., L.P.A.

[57] ABSTRACT

Flooring structure having a rigid horizontal base and a tile or terrazzo top flooring layer. This flooring structure also has a crack isolation layer between the base and the top flooring layer. The crack isolation layer comprises a hard, essentially rigid material which is in load bearing relationship with the base and the top flooring layer and which extends over about 50 percent to about 80 percent of the surface area of the crack isolation layer as measured in the horizontal direction. The crack isolation layer may be in the form of a fracturable sheet or in the form of pilings. The remaining portion of the crack isolation layer may be occupied by a deformable material.

7 Claims, 4 Drawing Sheets

TILE FLOORING STRUCTURE

CROSS REFERENCE TO RELATED APPLICATION

This application is a continuation-in-part of applicant's earlier application, Ser. No. 07/433,656, filed Nov. 8, 1989, now U.S. Pat. No. 5,052,161 granted Oct. 1, 1991.

TECHNICAL FIELD

This invention relates to tile flooring structures, and more particularly to tile flooring structures in which cracking of a hard flooring material, such as tile or terrazzo, due either to lateral shifting of the base or to impact load on the flooring material, is minimized.

BACKGROUND ART

Flooring installations comprising a hard, brittle flooring material such as tile or terrazzo on a rigid coherent base (typically concrete) have been widely used for years in public buildings, such as shopping malls, banks and office buildings. Such flooring installations are used above, at and below grade. In the latter two cases (at or below grade), a concrete base or slab is typically supported on a sub-base, i.e. the ground. A major problem is encountered in such installations. Concrete shrinks and generally cracks as it cures. In at grade and below grade installations, such shrinkage and cracking result in dimensional changes in the horizontal (or lateral) direction. This sets up stresses between the concrete base or slab and the sub-base (the ground) and between the concrete base and the flooring. In the case of a direct bonded flooring installation (one in which the flooring material is firmly bonded to the base), lateral shifts in the base are broadcast upwardly to the flooring material and may cause the flooring to crack. In a structural deck (i.e., an above ground installation), cracks tend to be small (and more frequent) due to the use of reinforcing bars in the concrete base. However, the concrete base deflects slightly, and this deflection or sagging places the flooring material under stress and may cause cracking.

Prior to and shortly after World War II, most ceramic tile and terrazzo installations utilized "mud setting" beds. These beds were composed of a lean mixture of sand and cement, placed fairly dry and generally not bonded to flooring base surface. Typically the mud setting bed was separated from the base with 15 pound roofing felt or the like. Tiles were fairly thick, e.g. ¾ inch to 1¼ inches thick and, the mud beds were generally in the range of about 1¼ to 1½ inches thick. The same basic systems were used for terrazzo flooring.

FIG. 1 shows a representative mud bed installation. In FIG. 1, mud bed installation 30 comprises a base 32 of hard coherent material, usually concrete (or alternatively, wood); a top flooring 34 of tile, terrazzo or other hard, brittle flooring material which is in the form of individual "squares" (or pieces of other simple geometric shape). The flooring material pieces are held together by means of grout 36 in the spaces between adjacent tiles, and a mortar layer 38 which is applied to the underside of the tiles. The tiles 34 are typically about ¾ inch to about 1¼ inches thick. Between the mortar 38 and the concrete base 32 are a "mud" bed 40 (a dry-pack sand/cement mortar setting bed) which is typically about 1¼ inch to 1½ inch thick, and (between the mud bed and the concrete base) a sheet or membrane 42 of a compressible material such as 15 pound roofing felt or the like.

Since the flooring system was not bonded to the base, the base was free to move laterally with respect to the rest of the system. Although this created some problems, it also offered the significant advantage that both the tile and the base (when a concrete base was used, which was typical) was protected from cracking. Shear forces caused by horizontal movement of the base were not transferred to the top flooring surface. In addition, the very thickness of the system permitted a transfer of live impact loads on the top flooring system to dissipate to minimal levels prior to reaching the base level. (An "impact load" as the term is used herein denotes a high-stress on the top flooring surface. It is typically caused by a sharp object striking the flooring surface).

Such live load impact force on the top flooring 34 is shown by the downward arrow "F" in FIG. 1. Two sets of broken lines extend downwardly and outwardly from the point of impact of force "F" in FIG. 1. These represent the area over which the force "F" is dissipated as it is broadcast downwardly through the flooring structure. The dissipation angle would ordinarily range from 45° (represented by the inner pair of broken lines) to 60° (represented by the outer pair of broken lines). As is evident, the force "F" is greatly attenuated by the time it reaches space 32, due to the thickness of the flooring 34 and the bed 40.

Beginning in the early 1950's, the thick tile floor systems described above gave way to thin set systems, utilizing much thinner tiles, rarely over ½ inch thick. Flooring systems of this type were less costly, lighter and are more easily coordinated with installations of carpet or vinyl flooring.

Modern thin-set flooring installations are of two general types. In one type, shown in FIG. 2, tile or other hard flooring material (such as terrazzo) is direct bonded to the base. In FIG. 2, a direct bonded installation of this type comprises a concrete base 32, a top flooring layer 34 of tile in the form of individual pieces or "squares", which are held together by means of grout 36 between adjacent pieces and mortar 38 applied to the underside of the tiles. (The flooring layer 34 also has expansion joints not shown). The mortar 38 is in direct contact with the concrete base 32 (hence the term "direct bonded"). The top flooring layer 34 may have expansion joints. (Also, the concrete base 32 may have control joints which prevent the spread of cracks). Because of the thinness of the installation, stresses at the interface between mortar 38 and concrete base 32 due to a live impact load on the tile or terrazzo 34 are much greater than is the case in a mud bed installation as shown in FIG. 1. Within the general field of the flooring structure 30 (i.e., away from the edges of the flooring structure and away from any joints in either the base 32 or the flooring 34), the concrete base 32 supports both the dead weight load of the flooring and mortar thereabove as well as any vertical live impact loads (except those which exceed the impact strength of the flooring material). However, there are horizontal stresses, especially at interfaces (e.g. between the base 32 and the mortar thereabove) in the flooring structure, and failure of the flooring layer may occur due to these horizontal stresses. Also, concrete shrinkage cracks are broadcast to the top flooring material. This type of system has very little "give" permitting relative lateral movement between the top flooring material 34 and the base 32. A direct bonded flooring structure employing terrazzo flooring will be generally be similar to that shown in FIG. 2, except that the terrazzo pieces are typically set in a mortar matrix and grout 36 and a separate bed mortar layer 38 are not required.

Shrinkage or cracking in the concrete base will therefore lead to failures in the flooring layer 34.

Systems of the type shown in FIG. 2 are the most widely used type of tile or terrazzo flooring systems in buildings built from the 1950's to the present.

A less widely used system is shown in FIG. 3. The flooring system 60 therein differs from that shown in FIG. 2 in that it includes a thin membrane 62 interposed between the mortar layer 38 and the base 32. Such system insulates the flooring tiles from cracks in the concrete base. On the other hand, flooring tiles are even more vulnerable to cracking due to impact load than is the case in the direct bonded system such as shown in FIG. 2. This is because the relatively resilient membrane 62 permits the bottom surface of the mortar layer 38 to be placed in tension when the flooring is struck by an object which causes an impact load. As is well known, mortar, concrete and ceramic materials have high compressive strength but low tensile strength. Hence, an installation such as that shown in FIG. 3 is quite vulnerable to impact loads.

Applicant's co-pending application, Ser. No. 07/433,656, filed Nov. 8, 1989, now U.S. Pat. No. 5,052,161, issued Oct. 1, 1991 provides a structure which greatly minimizes tile or terrazzo cracking due to either impact load or dimensional changes in a concrete or wood base in a thin-set system. Basically, a thin plastic crack isolation sheet having upstanding dimples is interposed between the concrete or wood base and the tile bed mortar on the underside of the tile or terrazzo layer, so that the base of the sheet is on top of the wood or concrete base and the sheet's dimples rise upwardly from the base. The space between the sheet base and the tile bed mortar, which is not occupied by dimples, is filled with mortar which may be called compression bed mortar. This crack isolation structure comprising the above-described crack isolation sheet and compression bed mortar, with air space beneath the dimples, provides support from the concrete (or wood) base for the tile (or terrazzo) top flooring layer, so that the flooring layer can withstand substantial impact loads, and also protects the flooring layer (tile or terrazzo) from stresses due to lateral shifting (occasioned by shrinkage or cracking) of the base. This compression bed mortar may become cracked at the stress site, but this protects the crack from spreading further and the compression bed mortar, even when cracked, retains its compressive strength and ability to function. Applicant now believes that the ability of this system to prevent cracks from spreading is due primarily to the compression bed mortar.

DISCLOSURE OF THE INVENTION

This invention provides a flooring structure comprising:

(a) a hard, coherent and essentially incompressible base having essentially flat level upper surface;

(b) a hard fracturable top flooring layer;

(c) an essentially horizontal crack isolation layer between said base and said top flooring layer, said crack isolation layer having an essentially horizontal planar bottom surface, said crack isolation layer comprising a hard, essentially non-compressible rigid material which is load bearing relationship with said base and said flooring layer and which extends over from about 50% to about 80% of the surface area of the crack isolation layer as measured along said bottom surface;

(d) means for bonding said rigid material of said crack isolation layer to said base; and (e) rigid coherent bonding material above said crack isolation layer and below said top flooring layer for bonding the rigid material of said crack isolation layer to said top flooring layer.

The flooring structure is essentially devoid of any deformable material between the crack isolation layer and either the top flooring layer or the base which will substantially alter the load bearing characteristics of the structure.

In a preferred embodiment, the base is concrete and the top flooring material comprises tiles in the form of individual pieces (e.g. squares) which are laid in adjacent, edge-to-edge relationship, with a mortar-like compression material (e.g., grout) filling the gaps between adjacent pieces. In another preferred embodiment, terrazzo is used as the flooring material.

DESCRIPTION OF THE PREFERRED EMBODIMENTS

This invention will now be described in detail with reference to several preferred embodiments thereof, as particularly shown in the accompanying drawings.

Figure 4:
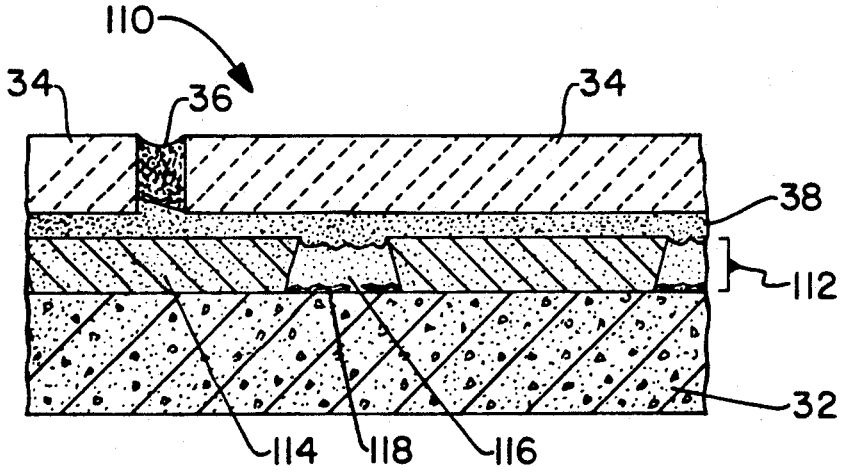
FIG. 4 is a vertical section view of a flooring structure according to a first embodiment of this invention, in which a precast, rigid fracturable crack isolation sheet having holes is interposed between a rigid base and tile flooring.
Figure 6:
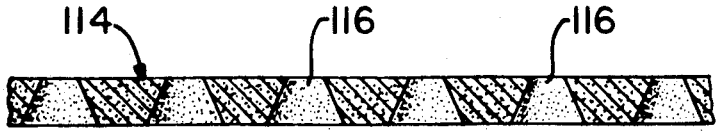
FIG. 6 is a vertical sectional view of the crack isolation sheet taken along line 6—6 of FIG. 5.
Figure 5:
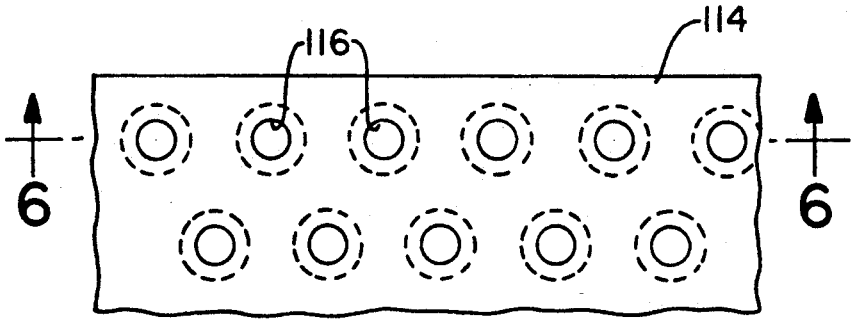
FIG. 5 is a top plan view of the precast rigid crack isolation sheet.

FIGS. 4–6 illustrate a first embodiment of this invention. Referring to FIGS. 4–6 and especially to FIG. 4, a flooring structure 110 according to this first embodiment of the structure comprises a base 32 of hard coherent material, usually wood or concrete (and typically concrete); a top flooring layer or course 34 which is spaced from and generally parallel to base 32 and which comprises a plurality of pieces (e.g., squares) of tile which are separated by grout 36 and held together by means of a mortar layer 38 which is applied to the underside of the tiles.

Figure 1:
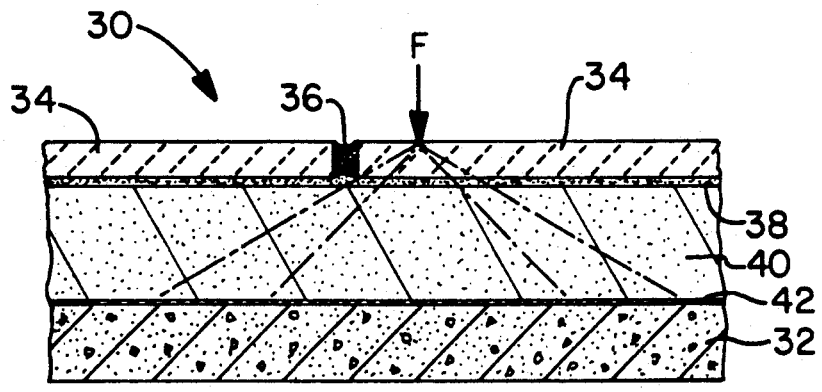
FIG.-1 Prior Art
FIG. 1 is a vertical sectional view of a prior art mud bed flooring structure.
Figure 2:
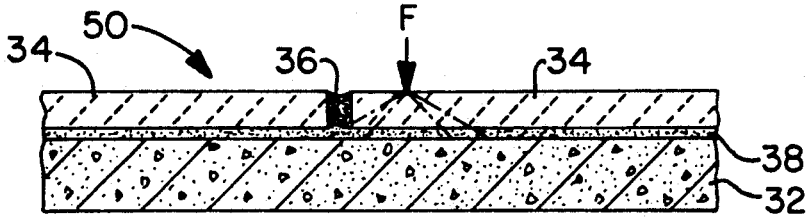
FIG.-2 Prior Art
FIG. 2 is a vertical sectional view of a prior art flooring structure in which a tile flooring is directly bonded via mortar to a rigid coherent (e.g. concrete) base.
Figure 3:
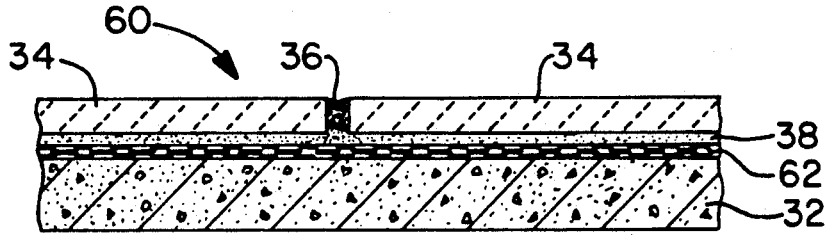
FIG.-3 Prior Art
FIG. 3 is a vertical sectional view of a thin-set tile flooring structure which includes a flexible membrane interposed between a concrete base and tile flooring.

The base 32, the flooring material 34, and the grout 36 and tile bed mortar 38 may be similar to their correspondingly numbered counterparts as shown in FIGS. 2 and 3.

While the base 32 may be of any desired hard, rigid, coherent material, including both wood and concrete, the advantages of this invention are greatest in flooring structure employing a concrete base, since concrete is more prone to lateral (horizontal) shifts due to dimensional changes than are other suitable base materials, including wood. Also, concrete is very widely used as the base material in contemporary building flooring structures.

The concrete base may have control joints as is known in the art. Also, the flooring layer 34 may have expansion joints as is known in the art. Furthermore, the concrete which forms base 32 may be reinforced, and may be prestressed or post-tensioned where desired, also as is known in the art.

The base 32 has an upper surface which is essentially flat or planar and usually essentially level, but not necessarily smooth. In fact, particularly in the case of concrete, there will be some surface roughness or asperities. The base 32 extends over the entire length and width of the flooring structure although it may be subdivided into sections with joints between sections(to control the spread of cracks) and may have openings for utility lines (e.g., electricity and water). Further description throughout this specification will be with reference to concrete, which is the most widely used base material used in modern building construction although wood may be used instead.

The flooring layer 34 may comprise tiles of conventional shape (e.g., square) and thickness, e.g., about ½ inch (about 1.27 cm) or less. As indicated earlier the flooring may be terrazzo, or concrete where the top surface is to be covered with carpeting or plastic sheet flooring material or where surface appearance is not important.

A crack isolation layer 112 is interposed between the base 32 and the tile bed mortar 38. This crack isolation layer or compression bed comprises a plurality of precast rigid crack isolation sheets 114 which may have a thickness of at least about ⅛ inches (about 3.1 mm) with a thickness of about 3/16 inch (about 0.48 cm) being typical. The thickness of sheets 114 in building flooring installations will usually not exceed about 5/16 inch (about 0.8 cm) for economic reasons. The sheets are typically rectangular (including square) having a length and width convenient for handling and installation, say from about 6 inches (about 15 cm) square up to about 4 feet (about 1.2 meters) square. The crack isolation sheets 114 are made of a rigid material having high compressive strength, for example fired clay, cement, or a thermosetting resin such as phonolic, or two-part chemically reactive plastics such as epoxies or urethanes. The crack isolation sheets 114 may be laid edge to edge in closely abutting relationship so as to cover the entire area of the flooring structure 110.

Crack isolation sheet 114 has therein a plurality of spaced holes 116, typically either cylindrical or (as shown) frustoconical in shape. These holes are arranged in a regular two dimensional geometric pattern, as for example triangular (as shown in FIG. 5), square or hexagonal. In the triangular pattern shown the holes are arranged in a plurality of parallel rows, and in fact three (3) sets of parallel rows, mutually intersecting each other at about 60° angles are recognizable. When the holes are arranged in a square pattern, there are two sets of parallel rows which mutually intersect each other at right angles. The holes may have either vertical sidewalls (in which case the holes are cylindrical) or sloping sidewalls as shown (in which case the holes are frustoconical). A sheet 114 having frustoconical holes is more easily cast or molded than one having cylindrical holes; a sheet having cylindrical holes and one having frustoconical holes are essentially equally effective for preventing spread of cracks from the base 32 to the flooring layer 34 while providing support for both dead weight (of the flooring layer 34 and the tile bed mortar 38) and live impact loads which are broadcast from the flooring layer to the base.

The dimensions of holes 116 are such that the surface area of solid non-compressible material as measured along the bottom surface of each sheet 114 is from about 50 to 80% of the total theoretical or geometric surface area or the sheet (i.e., the product of the length times the width of the sheet, assuming that it is in the preferred rectangular shape) while the surface area of the holes constitutes the remaining 20 to 50% of the total. It is important for the bottom surface of each sheet to be essentially planar and in load transmitting interfacial engagement with the top surface of the base 32. It is also important for the interface formed between the bottom surface of the solid non-compressible material of sheet 114 and the top surface of the base 32 to occupy from about 50 to about 80% of the total surface area of the top surface of the base 32, which is also the total bottom surface area of the crack isolation layer 112. (The two surface areas are virtually identical since crack isolation sheets 114 are disposed in edge to edge relationship over the entire area of base 32 with gaps or joints between adjacent sheets 114 which are very small in surface area compared to the surface areas of the sheets 114 themselves). The hole dimensions and spacings which achieve the required surface area of solid material are less important. For example, the desired surface area range can be achieved with holes which are about ⅜ inch in diameter (measured along the bottom surface of the sheet 114) and spaced apart about ⅝ inch center to center in a triangular pattern as shown in FIG. 5. It is preferred, however, for the distance between adjacent holes to be at least about ¼ inch and not more than about ⅝ inch, measured edge to edge.

The crack isolation sheets 114 are bonded to the tile or terrazzo course 34 by means of the tile bed mortar layer 38. The crack isolation sheets 114 are bonded to the base 32 by means of a thin layer 118 of adhesive. The layer of adhesive between the base 32 and the bottom surface of a crack isolation sheet 114 is very thin (and is therefore not shown in FIG. 4) so that the adhesive will not alter the load bearing and transmitting characteristics of the flooring structure and yet at the same time will bond the crack isolation sheets 114 to the base 32. The thickness of adhesive layer 118 is much greater in the holes 116 as will be described hereinafter. The term "adhesive" is used herein only to refer to an essentially "soft" material which is capable of absorbing a limited amount of horizontal movement (usually in the range of about ⅛ inch) while still retaining elastic and adhesive characteristics. The adhesive is a deformable, elastic and typically elastomeric material. The adhesive has some degree of elongation, typically at least 50%. Representative adhesives (all known in the building construction art) are bitumens, polyurethanes, soft epoxies, soft acrylics, soft acrylic-reactive materials and the like. The preferred adhesive materials are the materials which are manufactured and applied in the liquid state, and which cure upon air drying to form an elastic and preferably elastomeric substance which has the qualities of tack and elongation (preferably at least about 50%) which are necessary in an adhesive.

The bottom surfaces of crack isolation sheets 114, which are planar, normally lie essentially in a common plane which is essentially horizontal. This plane represents the bottom plane of the crack isolation layer 112.

A preferred method of building the flooring construction shown in FIGS. 4–6 is as follows: crack isolation sheets 114 are manufactured (precast) ahead of time and away from the job site. The top surface of base 32 is completely covered with a thin layer of adhesive 118 which is preferably in liquid form. Then the crack isolation sheets 114 are laid on top of the adhesive in edge to edge touching relationship so that the entire base is covered with these crack isolation sheets. Then the upper surfaces of the crack isolation sheets (which should lie in a common plane) are gently rolled with enough force to force most of the adhesive out from between the opposed upper surface of base 32 and bottom surface of sheets 114 and into the holes 116 of the crack isolation sheets. Sheet 114 usually cracks during rolling. This is beneficial; it enables these sheets to perform their crack isolation function. The amount of adhesive remaining at the interface between the base 32 and a crack isolation sheet 114 is undetermined (and probably indeterminate) but in any case is sufficient to provide an adhesive bond between the base and the crack isolation sheet but insufficient to alter the load transmitting characteristics from the crack isolation sheets 114 to the base 32. This is important, because any appreciable thickness of elongatable material between the base 32 and the crack isolation sheets 114 would result in placing the lower portion of the crack isolation sheets in tension whenever an impact stress is applied from above and (as pointed out above) this increases the likelihood of cracking, due to the low tensile strength which is typical in rigid non-metallic materials having high compressive strength. Since the crack isolation sheets 114 are bonded to both the base 32 below and the flooring material 34 above, it is evident that the entire flooring structure shown in FIG. 4 is bonded together as a unitary assembly.

The structure of the crack isolation sheets 114 prevents cracks therein from spreading any great distance. When an impact load F is applied to the flooring material 34, this impact load is communicated to the crack isolation sheets and then to the base 32.

Similarly, any lateral shifting of the base 32, due for example to shrinkage or cracking, will stress the crack isolation sheet 114 and cause the crack isolation sheet or portion thereof to slide. This prevents further transmittal of the stress upward and protects the flooring course 34.

The high elongation adhesive material 118 which extends across holes 116 just above the base 32 helps to maintain the integrity of the flooring structure 30 as a whole.

The flooring structure 110 possesses all of the advantages of both the direct bonded structure of FIG. 2 and the structure 60 of FIG. 3 wherein a membrane 62 is provided for crack isolation, with none of the disadvantages of either structure. The crack isolation sheets 114 provide substantially as great load bearing capacity for dead weight load and live impact load as does the direct bonded structure shown in FIG. 2. At the same time, the crack isolation layer 112 with its crack isolation sheets 114 effectively isolates the top flooring layer 34 from stress due to lateral (horizontal) shifts in the base 32, so that such lateral shifts do not cause failure of the flooring as they would in the flooring structure shown in FIG. 2. These same advantages are realized in all flooring structures according to this invention.

Figure 7:
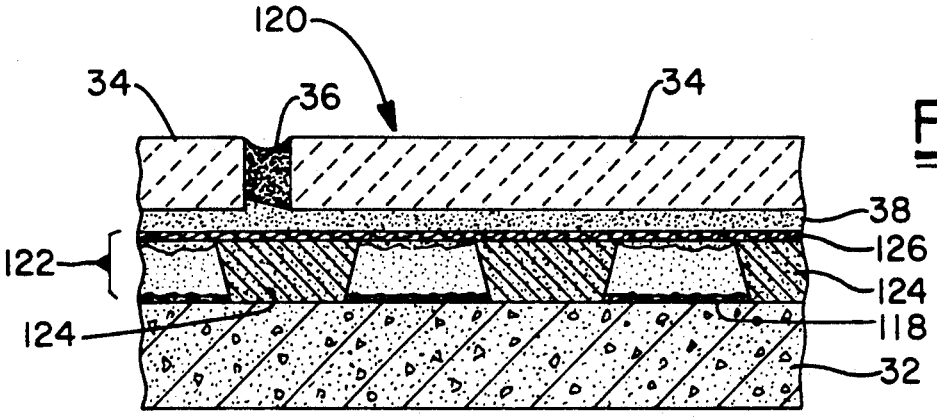
FIG. 7 is a vertical sectional view of a flooring structure according to a second embodiment of this invention, in which a crack isolation layer comprises a plurality of spaced rigid pilings.
Figure 8:
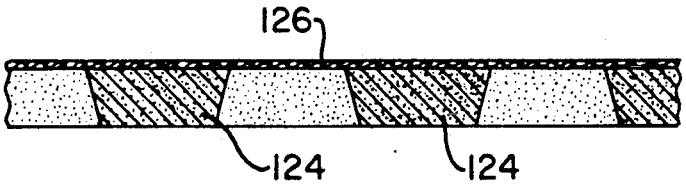
FIG. 8 is a vertical sectional view of a crack isolation layer (or structure), comprising a plurality of spaced, rigid, frustoconical pilings on a matting, according to the second embodiment of the invention.

A second embodiment of the invention is shown in FIGS. 7 and 8. A flooring structure (or installation) 120 according to this embodiment comprises a rigid coherent base 32 (usually concrete or wood), a top flooring layer or course 34 which is spaced from and generally parallel to base 32 and which comprises a plurality of pieces (e.g., squares of tile which are held together by means of mortar layer 38 of tile bed mortar on the underside of the tiles. The materials may be the same as in the embodiment shown in FIGS. 4–6.

A crack isolation layer 122 is interposed between the base 32 and the tile bed mortar layer 38. This crack isolation layer comprises (as best seen in FIG. 8) a plurality of spaced pilings 124 of rigid, essentially non-compressible material, which are mounted in spaced apart relationship on a cloth matting 126. These pilings can be made of any material having high compressive strength as for example concrete, mortar, or synthetic resin or plastic and in particular a thermosetting resin. Preferred resins or polymeric materials are as disclosed earlier. The pilings will normally be made in a simple geometric shape. For example, they may be cylindrical, frustoconical, square, triangular or polygonal. A preferred thickness for the piling is from about ⅛ inch (3.2 mm) to about 5/16 inch (or more for certain applications) (7.9 mm), with a thickness of about 3/16 inch (4.8 mm) being typical.

The matting 126 is preferably an open cloth of a fiber-forming material (either natural such as cotton or synthetic such as nylon and polyester). This matting 126 serves as a tensile matting which increases the tensile strength of the installation and provides resistance against horizontal sheet forces that are created when impact loads are applied to the top surface of flooring 34.

A tensile matting similar to cloth matting 126 can also be used in the embodiment shown in FIGS. 4–6. In this embodiment, such matting would be placed on the top surfaces of crack isolation sheets 114.

The pilings 124 are affixed to the matting in a desired regular two dimensional geometric pattern, e.g., either triangular, square or hexagonal, which the pilings are arranged in a plurality of parallel rows extending in one direction at locations which are determined by a second set of parallel lines extending at an angle with respect to the aforesaid parallel rows. The pilings may be bonded to the matting by means of suitable adhesive. The adhesive does not have to a strong adhesive, but just needs to be strong enough so that an assembly of pilings and matting as shown in FIG. 8 will stay together as it is assembled into a flooring structure 120 as shown in FIG. 7. In the case of cylindrical pilings arranged in a triangular configuration the pilings may be from ¾ inch (1.90 cm) to 1¼ inch in diameter (or smaller or larger) and the minimum distance (edge to edge) between adjacent pilings may be from about ⅛ inch to about ⅜ inch.

Figure 9:
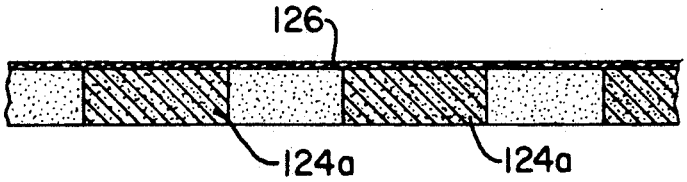
FIG. 9 is a vertical sectional view similar to FIG. 8 except that the pilings shown therein are cylindrical.

The diameter of the pilings and their distance apart will be chosen so that the total surface area of the pilings 124, measured along the bottom surfaces (which are planar and which lie in a common horizontal plane) will be from 50 to 80% of the total surface area of a subassembly as shown in FIG. 8 or FIG. 9 (also as measured along this same horizontal plane). In the case of a frustoconical piling, as shown in FIG. 8, the surface area for this purpose will be taken as the surface area of the smaller base, which is the base which is in interfacial load transmitting relationship with the concrete or wood base 32.

The bottom surfaces of the pilings 124 in the flooring structure 120 lie in a common plane (or substantially in a common plane) and are in interfacial load bearing relationship with the base 32. A thin layer 118 of adhesive, most of which is in the space between pilings as shown in FIG. 7, bonds the pilings to the base 32. The tile bed mortar layer 38 bonds the pilings to the flooring course or layer 34.

By choosing the dimensions and spacing of the pilings such that their total bottom surface area (the surface area which is in interfacial load bearing relationship with the base 32) is from 50 to 80% of the total top surface area of the base, one provides sufficient support for the flooring on the base, so that sufficient compressive support is provided over the entire height of the flooring installation 120 to protect the flooring from cracking from impact loads. At the same time the flooring is protected from stresses originating with the base due to lateral shifting.

Figure 10:
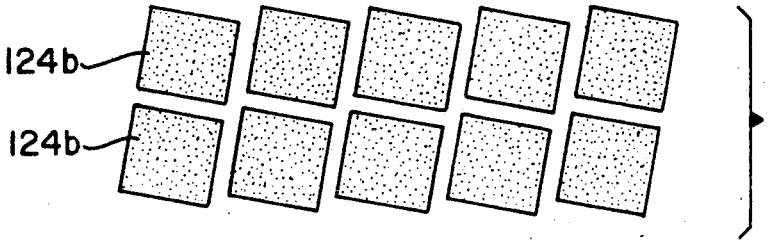
FIG. 10 is a plan view of an array of square pilings, set at a slight angle, for a crack isolation structure for the flooring structure of FIG. 7, with the matting omitted.

FIG. 10 illustrates an array of square pilings **124*b*, which are preferably set at a slight angle (about 6° or 8° ) as shown instead of being aligned "straight" so that the edges of all pilings in a given row (whether extending horizontally or vertically as seen in FIG. 10) are aligned. By setting the tiles 124*b* at a slight angle, one can maximize the surface area in a crack isolation layer which is occupied by these hard rigid pilings while increasing the distance between diagonally opposite pilings at corners where four pilings are in closely adjacent relationship. This improves the ability of the structure to withstand shear while remaining intact. Such an array of square pilings can replace the frustoconical pilings shown in FIG. 8 or the cylindrical pilings shown in FIG. 9**.

Figure 11:
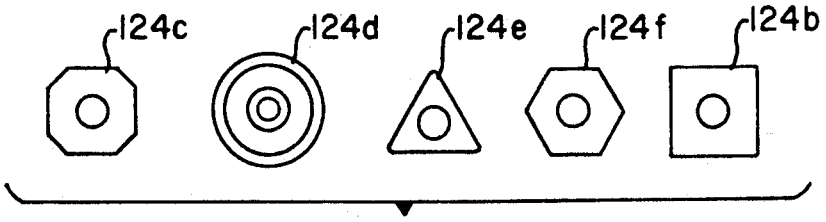
FIG. 11 is a plan view showing several different shapes which the pilings in the embodiment of FIG. 7 may take.

FIG. 11 shows in plan view pilings of other shapes which may be used in the embodiment of FIG. 7. These include for example, an octagonal piling **124*c*, a cylindrical piling 124*d* with a frustoconical hole in the middle and beveled outside edge (this piling is shown in bottom plan view), a triangular piling 124*e*, a hexagonal piling 124*f* or a square piling 124*b*. All of these pilings are shown as having a hole in the center, which may be omitted. Adhesive 118 will migrate into central holes as well as into the space between pilings as the flooring structure 120 is constructed. The pilings can be slightly larger in size when there is a central hole than when there is no central hole. Best results are achieved when the crack isolation layer 122 of flooring structure 120 has no long spans where there is no rigid material (such as piling 124) and no long span in which there is no adhesive material 118 along the bottom crack isolation layer 122** (other than the very small amount under the pilings).

The flooring structure 120 may be constructed as follows: first, arrays of pilings 124 (or **124*a*, 124*b*, etc) are laid out in a desired two dimensional geometric pattern (triangular, square or hexagonal) on one face of an open matting sheet 126 and adhered thereto with an adhesive. For convenience it is preferred to use a plurality of rectangular matting sheets 126. This may be done either beforehand or at the job site. A thin layer of liquid or plastic adhesive is laid down on the top surface of base 32, as in the embodiment of FIG. 4, and then the pilings/matting subassembly is placed on top of this thin adhesive layer, with the matting 126 up as shown in FIG. 7. Then the top surface of the pilings 124 and the matting 126 is gently rolled with a roller. This causes the adhesive 118 to migrate to the space between pilings 124 (and to the holes in the centers of pilings, when present), leaving adhesive directly beneath the pilings 124. The amount of adhesive remaining directly beneath the pilings 124 is enough to adhere the pilings to the base 32** but not enough to adversely affect the load bearing and transmitting characteristics of the structure.

Figure 12:
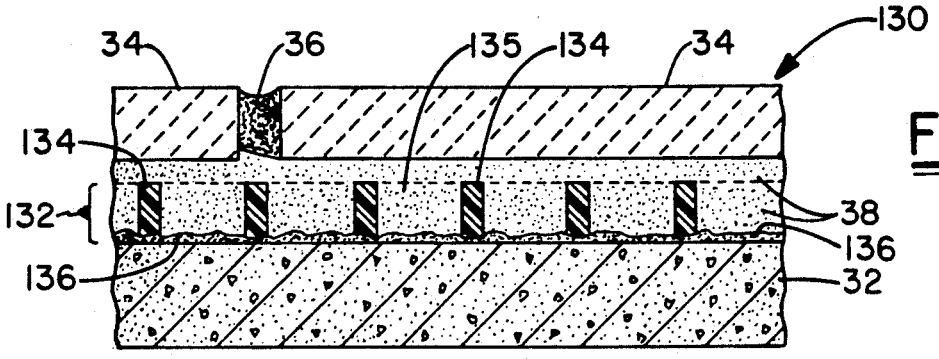
FIG. 12 is a vertical sectional view of a flooring structure according to a third embodiment of this invention, in which a crack isolation layer comprises an essentially soft, flexible and at least somewhat elongatable sheet (e.g., rubber of other elastomer) having therein holes which are filled with mortar or other non-compressible material, and which is bonded to the base by means of a thin layer of mortar.
Figure 14:
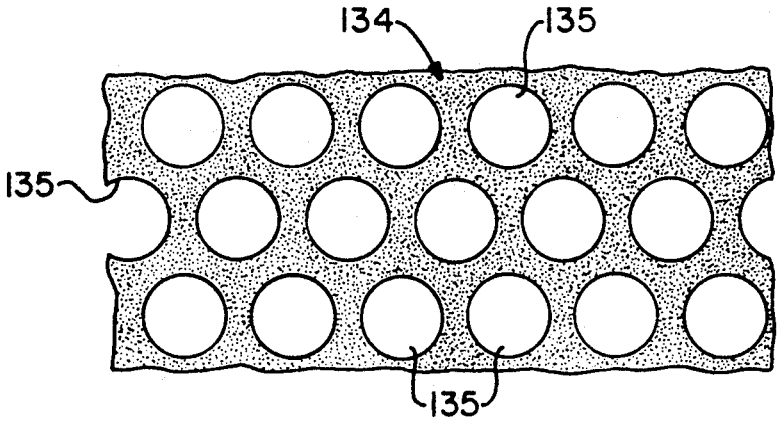
FIG. 14 is a plan view of a crack isolation sheet of soft material which is used in the structures shown in either FIGS. 12 or 13.

FIG. 12 represents a flooring structure according to a third embodiment of this invention. Flooring structure 130 according to this embodiment comprises a hard coherent horizontal base 32, a top flooring layer 34 made up of individual tiles with grout 36 between adjacent tiles or pieces and a bed 38 or mortar on the underside of the tiles 34. (Terrazzo may be used instead of tiles if desired). This flooring structure also includes a crack isolation layer 132, which comprises a plurality of preformed rectangular sheets 134 of a soft, resilient and preferably elastomeric material as is best seen in FIG. 14. Sheet 134 has a plurality of holes 135 spaced apart and arranged in parallel rows in a regular two dimensional geometric pattern, e.g., triangular as shown in FIG. 14, or square or hexagonal. The holes 135 may be of any desired shape, and are illustrated as being cylindrical (a preferred shape), i.e., circular with vertical sidewalls. These holes are filled with mortar in the finished installation 130. Sheet 134 may be made of a soft, deformable material having an appreciable degree of elongation (at least about 50%) and resilience. Elastomers such as rubber (natural or synthetic) and EPDM (a terpolymer of ethylene, propylene and a small amount of a diene monomer) are particularly suitable. Cork is also a suitable material.

The flooring structure 130 also includes a thin layer 136 of mortar or other suitable bonding material having high compressive strength and very little elongation. This mortar layer 136 is formed on the top surface of base 32.

The flooring structure 130 may be assembled as follows: A first mortar layer (or base mortar layer) 136 is laid down on top of base 32. Then the premanufactured sheets 134 are laid on the fresh mortar in substantially touching edge to edge relationship. These sheets are then gently rolled or troweled down so that the lower flat surfaces thereof are forced into the mortar bed 136 and mortar in the bed 136 is forced upwardly into the holes 135. Then the bed 38 of tile mortar is poured; this bed completely covers the underside of the tiles in the flooring layer 34 and extends down into the holes 135 of sheet 134, meeting the base mortar at interfaces which are inside the holes 135. Finally, the flooring course of piles 134 is laid, and grout 36 is applied between adjacent tiles.

The flooring structure 130 provides three shear planes, i.e., at the base/mortar interface along the top surfaces of base 32, at the mortar/mortar interface between base mortar 136 and tile mortar 38, and at the top of the sheet 134.

The crack isolation layer 132 protects the course 34 of flooring material from horizontal (or lateral) shifts of the base by virtue of the above described shear planes. It also protects the flooring from live impact loads.

The area of the holes 135 in sheet 134 will constitute about 50% to about 80% of the entire area of the sheet 134 (this area being measured along either the top or the bottom horizontal surface of the sheet). In this way the percentage of the total surface area of the bottom surface of the crack isolation layer 132 which is devoted to rigid non-compressible material will be from 50 to 80%. The spacing of the holes 135 must be adequately close as to permit a live load applied at the top surface to be transmitted to the rigid material (mortar) in these holes while maintaining a maximum load at these locations which does not exceed the compressive strength of the mortar material or the tensile strength at the bottom of the tile or terrazzo flooring material. The sheet thickness, from about 1/16 inch to about 3/16 inch and typically about ⅛ inch (3.2 mm), is a function of the elongation capability of the sheet. The greater the elongation capability, the thinner the sheet may be. The mortars used for layers 136 and 138 must bond to the material forming sheet 134. In addition, the material for mortar layer 136 must bond to the base 32, and the material forming mortar layer 38 must bond to the flooring material.

In the event of horizontal movement of the base 32, e.g., in the event of a crack in the base (which will rarely exceed ⅛ inch), the adjacent portion of the base mortar layer 136 moves with the base, and shearing takes place at one or more of the shear planes which have been described above. The compressibility of the soft of compressible material forming sheet 134, and the bond between the sheet 134 and the mortar materials, enables the sheet to absorb this horizontal movement due to shrinkage or crack formation in the base while holding the flooring assembly 130 together. This shearing action makes it possible to protect the flooring from horizontal shifts in the base without compromising the compressive strength of the installation or its ability to absorb future horizontal shifts of the base.

A live impact load on the flooring layer 34 is transmitted downwardly and horizontally outwardly through the compression bed from the point of impact. Since there is a continuous course of rigid, high compression strength material from the flooring 34 down to the base 32 over 50 to 80% of the total area of the installation, the flooring material in protected from a tensile load on its underside and is thus protected from impact loads. The flooring 34 thus is protected both from impact loads on its top surface and from stress due to horizontal shifts in the base 32.

Figure 13:
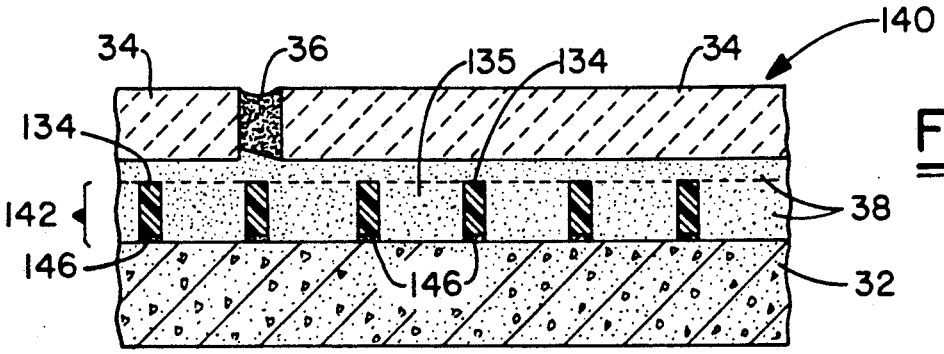
FIG. 13 is a vertical sectional view, similar to that shown in FIG. 12, except that the preformed soft sheet is bonded to the base by means of an adhesive.

FIG. 13 shows an alternative form of flooring installation according to this third general embodiment of the invention. In FIG. 13, 140 is a floor structure comprising base 32, flooring course or layer 34 spaced therefrom but bonded thereto, grout between adjacent tiles in the flooring layer 34, a bonding layer 38 of mortar or other rigid bonding material on the underside of the flooring layer 34, and a crack isolation layer 142 comprising a plurality of rectangular sheets 134 of soft compressible and preferably elastomeric material, as described with reference to FIG. 12 above. The materials forming this sheet may be as described above. The thickness of this sheet will be as described above. In the embodiment of FIG. 13, however, a very thin layer of adhesive 148 is applied to the bottom surface of the sheet 134, and the sheet 134 is thus adhered directly to the top surface of base 32. The bed of 38 of tile bed mortar extends downwardly through the holes 135 in the sheet 134 so that it is in direct contact with the top surface of base 32. Again, the surface area of holes 135 accounts for 50 to 80% of the total surface area of sheet 134, so that the surface area of rigid material in the crack isolation layer 142 is from 50 to 80% of the total surface area of this layer, as measured on a horizontal plane at the bottom of the layer.

The structure of FIG. 13 has shearing planes at the interface between the base 32 and the crack isolation layer 142 (i.e., at the top surface of the base) and at the top of the sheet 134.

The installation 140 of FIG. 13 protects the installation from impact loads on the flooring 34 and from horizontal shifting of the base in essentially the same manner as has been described with respect to the installation 130 shown in FIG. 12.

Figure 15:
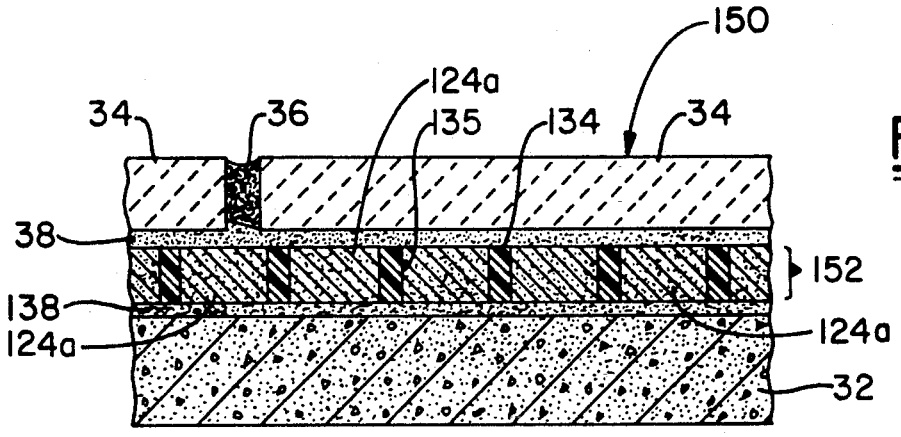
FIG. 15 is a vertical sectional view of a flooring structure according to a fourth embodiment of this invention, in which a crack isolation layer comprises a preformed sheet of soft elongatable material (e.g., rubber) having therein holes which are filled with preformed rigid pilings having the same shape as the holes.

FIG. 15 shows a flooring structure 150 as a whole according to the fourth embodiment of this invention. Flooring structure 150 comprises a generally horizonal hard, coherent base 32 of concrete or wood, a horizontal flooring layer 34 which is spaced from and generally parallel to base 32 and bonded to the base and which comprises a plurality of pieces (e.g., squares) of tile separated by grout 36 and held together by means of mortar 38 and a crack isolation layer 152 which is disposed between the base mortar layer 136 and tile mortar layer 38 and which is bonded to the base and the tile flooring by those respective mortar layers.

Crack isolation layer 152 comprises a plurality of rectangular sheets 154 laid edge to edge. Each sheet 154 comprises a sheet 134 of rubber or other deformable resilient material having therein a plurality of holes 135 arranged in a regular two dimensional geometric pattern (e.g., triangular as shown in FIG. 21), and hard rigid pilings **124*a* which are set into each of these holes. Flexible sheet 134 may be identical to its correspondingly numbered counterpart in the third embodiment of this invention, as shown in FIG. 17. Pilings 124*a* may be similar or identical to their counterpart as shown in FIG. 9. The holes 135 may be of any desired shape and may be arranged in any desired two dimensional geometric pattern, and the pilings 124***a* (or 124, 124*b*, etc) should be of the same shape as the holes 135. For best results the sidewalls of the holes and the circumferential edges of the pilings should be vertical. The pilings may be secured in the holes by any desired means, e.g., by means of adhesive, or by press fitting, with gripping facilitated either by making the pilings just slightly larger in diameter than the holes or by providing a flange which encircles the circumferential edge of each piling a corresponding groove in the sidewall of each hole.

The rigid pilings constitute 50 to 80% of the surface area of the crack isolation sheet, as measured on a horizontal plane extending through the sheet and conversely the flexible sheet material constitutes from 20 to 50% of the area.

The flooring structure 150 of the fourth embodiment acts in essentially the same way as the flooring structure 130 of the third embodiment (as shown in FIGS. 12 and 13) in isolating the flooring layer 34 from horizontal shifting of the base 32, and in preventing cracking of flooring tiles due to impact loads thereon.

The flooring structure 150 shown in FIG. 15 can be made as follows: the preformed composite sheets 154 of flexible sheet material 134 and pilings 124*a* are manufactured in advance and shipped to the job site. Then a thin layer or bed 136 of mortar is applied to the base 32. The preformed sheets 154 are set on this mortar bed in edge to edge relationship when the mortar is freshly applied and still moist. Slight pressure is applied to the upper surfaces of sheets 134 in order to embed them in the mortar. Then the tile bed layer 38 and finally the flooring tiles 34 and grout 36 are applied.

This invention has been described with reference to various embodiments. All are thin set constructions. In each case, however, a top flooring layer or course 34 of hard, rigid fracturable flooring material (preferably tile or terrazzo) is bonded through a compression bed to a rigid coherent base, typically concrete (or alternatively, wood), which is subject to lateral (i.e., horizontal) shifting of small magnitude. The magnitude of these shifts is typically no more than about ⅛ inch (about 3.2 mm). In each case the flooring structure comprises a horizontal crack isolation layer interposed between the flooring and the base, to support the flooring in such manner as to withstand impact stresses and to protect the flooring from damage due to lateral shifts in the base. This crack isolation layer is always bonded to the flooring by means of a rigid bonding material (e.g., mortar) and is bonded to the base either directly (with a very thin layer of adhesive) or through rigid bonding material (e.g., mortar). The crack isolation layer has a horizontal planar bottom surface of which 50 to 80% of the surface area is formed by the rigid material and the remainder formed by a flexible, resilient material having appreciable elongation (at least about 50%). This soft deformable material may be either an adhesive or a coherent sheet of elastomeric or other flexible resilient material. The hard rigid material of a crack isolation layer must extend the entire height of this layer in order to afford a continuous path of hard rigid high compressive strength material extending from the flooring 34 to the base 32. On the other hand, it is not necessary for the flexible material to extend over the entire height of the crack isolation layer, as long as it is disposed in the lower portion thereof. This flexible material maintains the structural integrity of the compression bed structure in the face of shear stresses which typically are most noticeable at shear planes at the top and bottom surfaces of the crack isolation layer (and which may also be observed at the interface between base 32 and the material immediately there above).

The flooring structures according to this invention possess all of the advantages of the structures of FIGS. 2 and 3 with none of the disadvantages. Resistance to live impact loads in the flooring structures of this invention is substantially as great as in the direct bonded structure such as those shown in FIG. 2. On the other hand, the crack isolation layers of the present invention protect the flooring from failure due to horizontal or lateral shifts of the base 32, something which is not achieved in the direct bonded structures such as those shown in FIG. 2. Such protection was previously achieved by use of an elongation membrane as shown in FIG. 3, but only with great loss (up to about 65%) in resistance to live impact loads as compared to those achieved in a direct bonded structure of FIG. 2 or in structures according to the present invention.

The flooring structures herein are intended primarily for interior use. However, they can also be used for exterior structures in climates where freezing does not occur, so that the flooring structure is not subjected to a freeze-thaw situation.

Installations according to the present invention can be used in either new buildings or renovations.

While this invention has been described with reference to preferred embodiments thereof, it shall be understood that these specific embodiments are disclosed by way of illustration and not limitation.

What is claimed is:

1. A flooring structure comprising:

(a) a generally horizontal base of hard rigid, coherent and essentially incompressible material;

(b) a top flooring layer comprising hard coherent fracturable material spaced from and generally parallel to said base;

(c) an essentially horizontal crack isolation layer between said base and said top flooring layer, said crack isolation layer having an essentially horizontal planar bottom surface, said crack isolation layer comprising a hard, essentially non-compressible rigid material which is in load bearing relationship with said base and said top flooring layer and which extends over from about 50% to about 80% of the surface area of the crack isolation layer as measured along said bottom surface; and (d) means for bonding said rigid material of said crack isolation layer to said base, and (e) rigid coherent bonding material above said crack isolation layer and below said top flooring system for bonding the rigid material of said crack isolation layer to said top flooring layer, wherein the rigid material of said crack isolation layer is in direct load bearing engagement with the bonding material thereabove and in direct load transmitting relationship with hard rigid material there-below, said flooring structure being essentially devoid of any material between said crack isolation layer and said base or between said crack isolation layer and said flooring layer which substantially alters the load bearing characteristics of the structure.

2. A flooring structure according to claim 1 wherein said base is concrete.

3. A flooring structure according to claim 1 wherein said top flooring layer is tile or terrazzo.

4. A flooring structure according to claim 1 wherein said crack isolation layer further comprises a deformable material capable of substantial elongation, said deformable material extending over the remaining 20% to 50% of the area of the bottom plane of said crack isolation layer.

5. A flooring structure according to claim 1 wherein said crack isolation layer comprises a precast rigid coherent essentially non-compressible sheet having therein a plurality of holes which are arranged in a regular two dimensional geometric pattern extending over the length and width of the sheet, said sheet having an essentially planar bottom surface, the rigid material forming said sheet extending over about 50% to about 80% of the area of said bottom surface and said holes extending over the remaining 20 to 50% of the area.

6. A flooring structure according to claim 1 wherein said crack isolation layer comprises a plurality of rigid, coherent essentially non-compressible pilings arranged in a regular two dimensional pattern, said pilings having top and bottom surfaces, the bottom surfaces being in direct load transmitting relationship with rigid material there below and the top surfaces being direct load bearing relationship with rigid material there above, said pilings extending over about 50% to about 80% of the area of said crack isolation layer as measured on a horizontal plane of the bottom thereof.

7. A flooring structure according to claim 1 wherein said crack isolation layer comprises a preformed deformable sheet of a material which is capable of substantial elongation, said sheet having a plurality of holes arranged in a regular geometrical two dimensional pattern, said holes constituting from about 50% to about 80% of the horizontal surface area of said sheet, said holes being filled with hard, rigid, coherent and essentially non-compressible material which is in direct load bearing relationship with hard rigid material there below and with said rigid bonding material there above.

* * * * *